United States Patent [19]

Clark

[11] 4,062,111

[45] Dec. 13, 1977

[54] SHARPENER MOUNTING STRUCTURE AND KNIFE GUARD FOR CIRCULAR KNIFE TYPE OF CLOTH CUTTING MACHINE

[75] Inventor: Frederick G. Clark, Naples, Fla.

[73] Assignee: Eastman Machine Company, Buffalo, N.Y.

[21] Appl. No.: 725,129

[22] Filed: Sept. 20, 1976

[51] Int. Cl.[2] ..... B25F 3/00

[52] U.S. Cl. ..... 30/139; 51/248

[58] Field of Search ..... 30/138, 139, 286, 264; 51/247, 248

[56] References Cited

U.S. PATENT DOCUMENTS

| | | | |
|---|---|---|---|
| 1,103,791 | 7/1914 | Maimin | 30/139 |
| 1,666,643 | 4/1928 | Edelman | 30/139 |
| 1,795,781 | 3/1931 | Komow | 51/247 |
| 1,983,129 | 12/1934 | Gury | 30/139 |
| 2,627,657 | 2/1953 | Etchen | 30/286 X |
| 3,812,584 | 5/1974 | Peter | 30/273 |

*Primary Examiner*—Harold D. Whitehead
*Attorney, Agent, or Firm*—Joseph P. Gastel

[57] ABSTRACT

A guard and sharpener construction for a rotary cutting machine having a base, a circular knife mounted on the base, a motor for driving the circular knife, a standard for mounting the motor above the base, an elongated slotted rod slidable to cover a segment on the leading edge of the circular knife, a pair of sheet-like guard members mounted on the mounting arms for the sharpener wheels, the guard members covering opposite sides of the knife above the segment, a pivotal shaft and associated mechanism for mounting the arms for movement between a sharpening and a non-sharpening position, with the rod member, the sheet-like guards and the sharpener arms being so oriented relative to each other so as to permit the sharpener to be used in all positions of the rod-like guard member, and a keyway and set-screw indexing structure for mounting the arms on the pivotable shaft.

13 Claims, 12 Drawing Figures

Fig. 1.
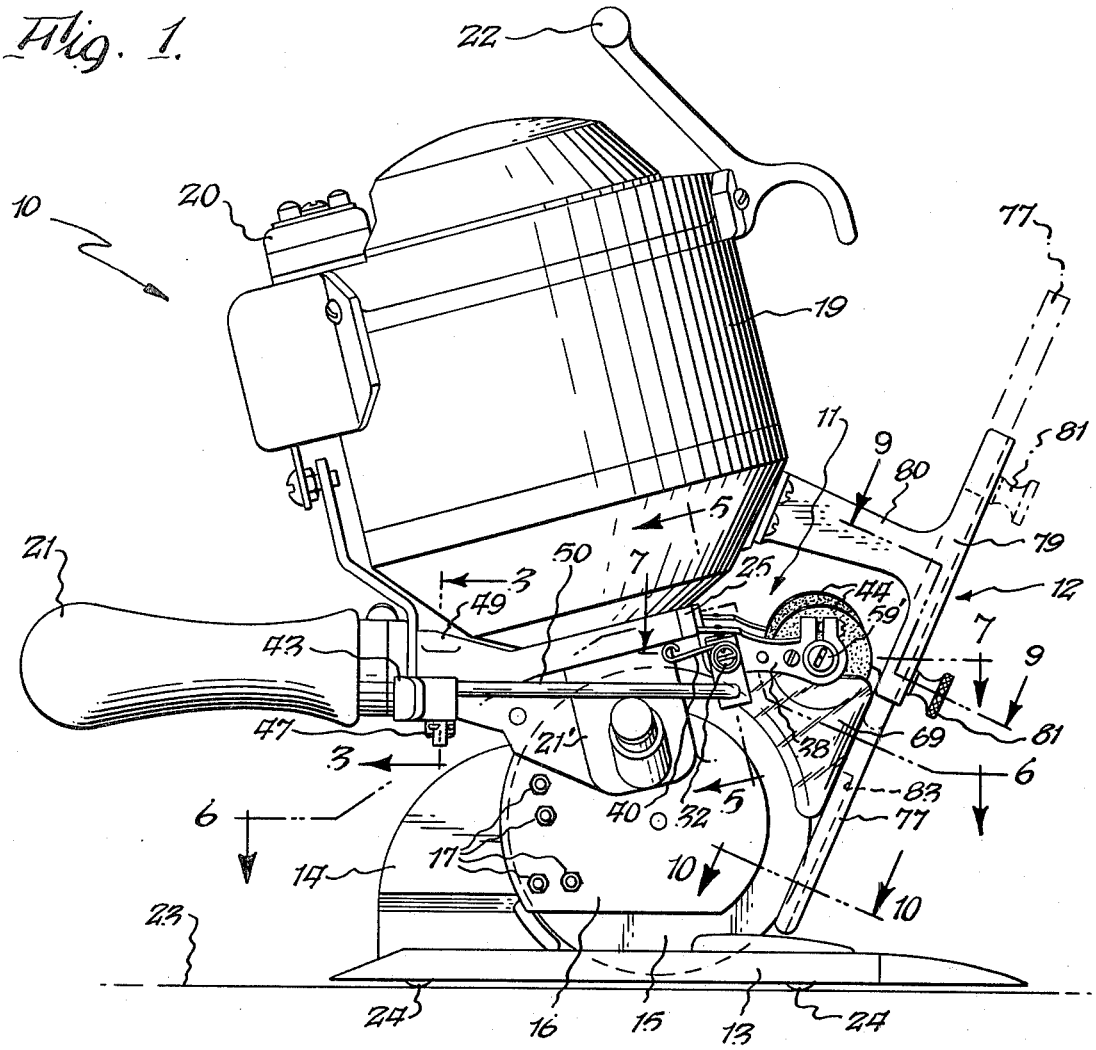
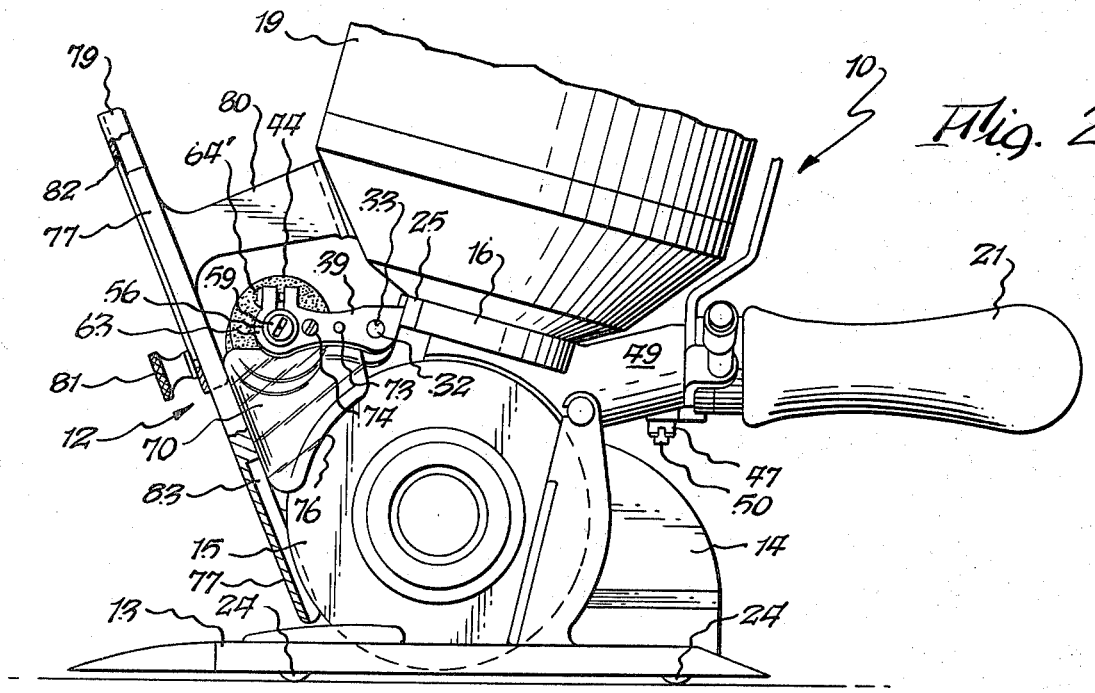
Fig. 2.

Fig. 3
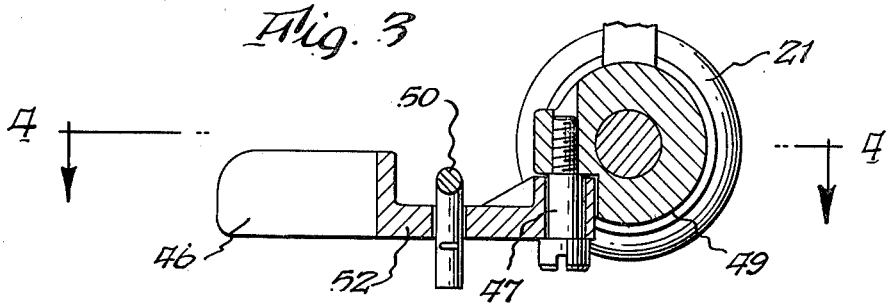
Fig. 4.
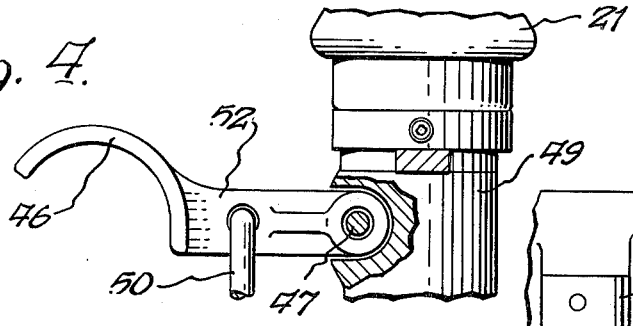
Fig. 5.
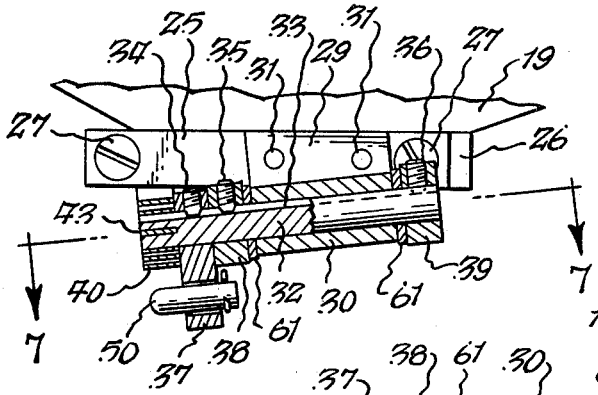
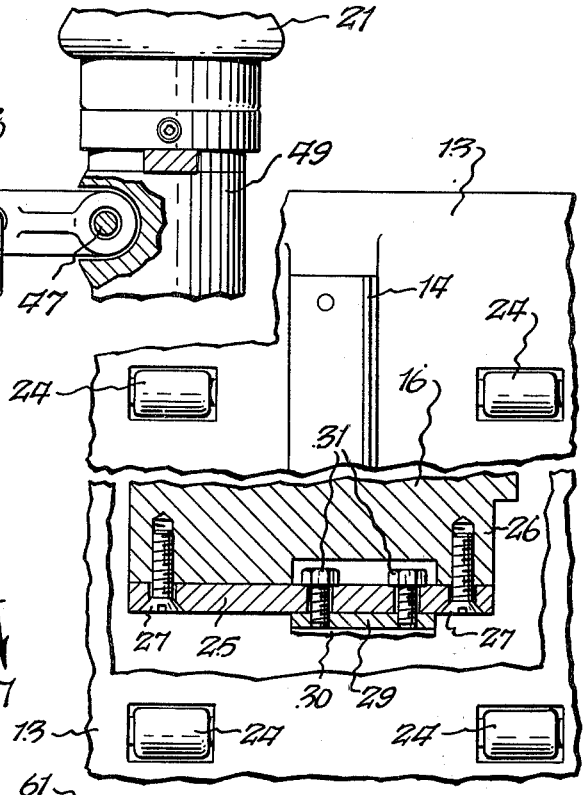
Fig. 6.
Fig. 7.
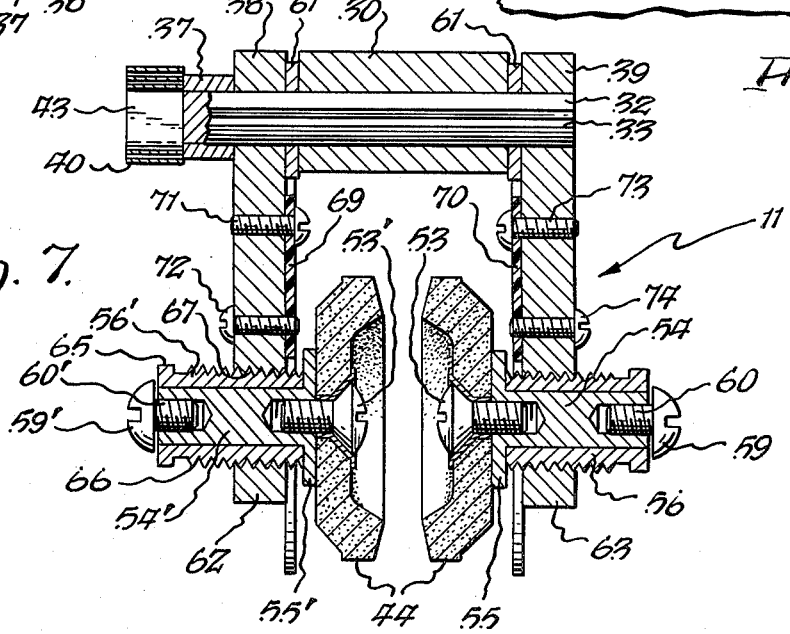

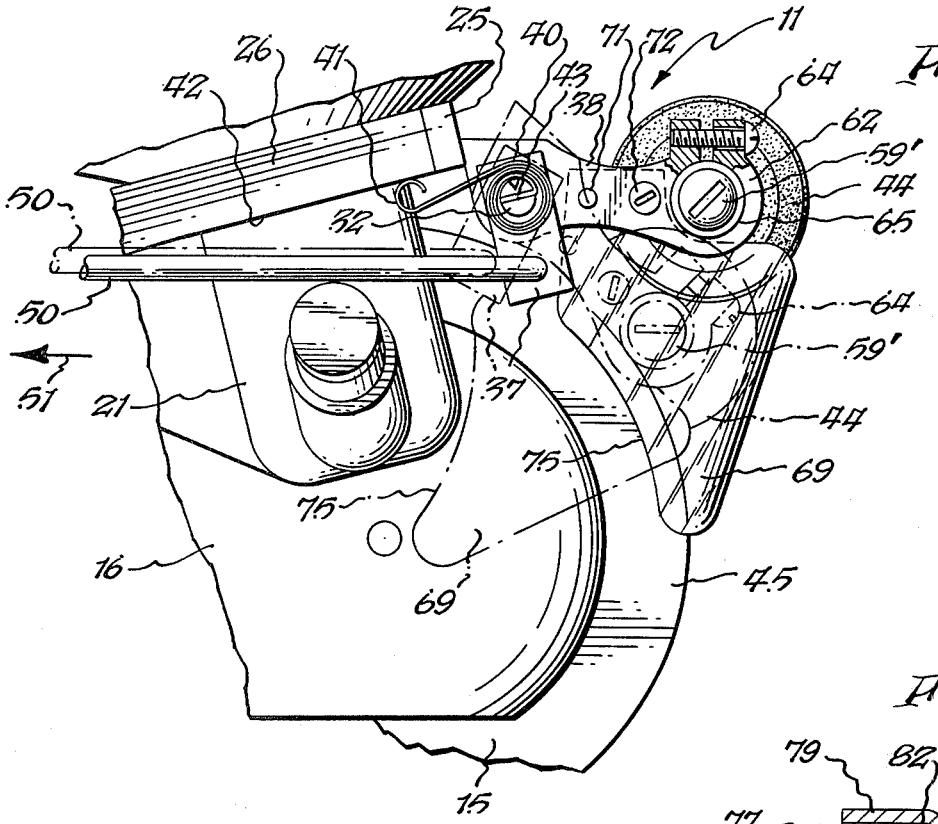
Fig. 8.
Fig. 9.
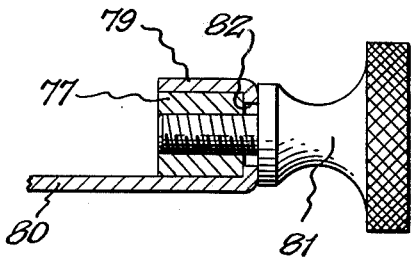
Fig. 11.
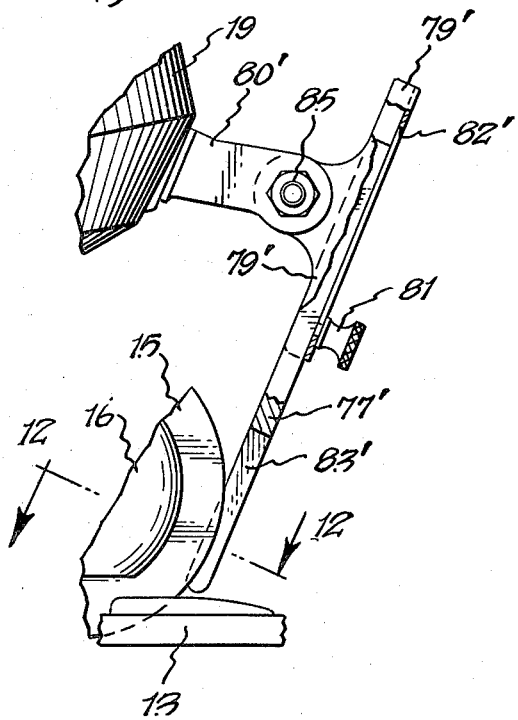
Fig. 10.
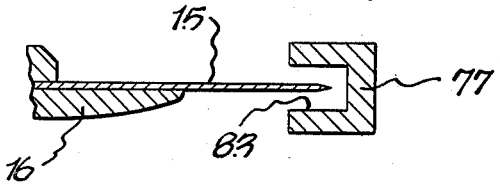
Fig. 12.
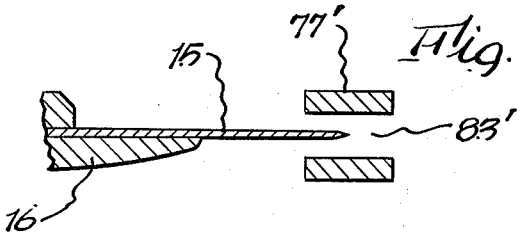

SHARPENER MOUNTING STRUCTURE AND KNIFE GUARD FOR CIRCULAR KNIFE TYPE OF CLOTH CUTTING MACHINE

The present invention relates to an improved sharpener mounting structure and knife guard for a circular knife of cloth cutting machine.

By way of background, cloth cutting machines utilizing circular knives are well known. However, guarding of the rotating knife when the machine is not actually cutting has posed a problem. In the past, various types of guards have been employed. One type of guard is shown in U.S. Pat. No. 3,812,584 and it is in the nature of a pivotal plate located on one side of the knife. However, this plate does not provide shielding for both sides of the knife. Furthermore, this type of guard does not permit the machine-mounted knife sharpener to be used for sharpening the knife unless the guard is located in a specific position on the machine. Another type of guard was also used which constituted a rod which extended tangentially to the knife edge. While this guard did not interfere with operation of the sharpening mechanism this type of guard did not extend over the peripheral edges of the blade, nor did it cover the entire leading portion of the blade.

In the past the knife sharpening mechanism on a circular blade type of cloth cutting machine was generally mounted by relatively complex and expensive structure. Furthermore, in certain machines blade guards mounted on the machine were attached to the sharpener wheel mounting mechanism in such a manner that if the guards had to be removed for any reason at all, the adjustment of the sharpener wheels could be changed. Furthermore, when it was necessary to change or adjust the sharpener wheels, the mounting means for the guard had to be loosened with the consequent requirement that the guard mounting means required retightening after the sharpening wheels were replaced.

It is accordingly one object of the present invention to provide an improved guard for a circular knife of a cloth cutting machine, the guard consisting of a simple rod and a pair of sheet-like guards which, in combination, cover both sides of substantially the entire leading edge of the knife in a highly expedient manner. A related object of the present invention is to provide an improved guard of the foregoing type wherein the guard members are mounted on the blade sharpener mechanism and wherein the rod-like member and the sheet-like guards are so oriented and mounted relative to each other so as to permit the sharpener mechanism to be used for sharpening the knife in all positions of the rod-like member, whereby the knife may be sharpened at any time whatsoever regardless of the position of the rod-like member.

Another object of the present invention is to provide an improved guard for a cloth cutting machine in which a pair of sheet-like members are so mounted on the arms of a sharpener mechanism in such a manner that the sheet-like members can be removed or replaced from the sharpener mechanism without adjusting the sharpener mechanism and the sharpener wheels can be adjusted or replaced without interference from the sheet-like guard members.

A further object of the present invention is to provide an improved sharpener mechanism for a circular knife which is extremely simple in construction and which permits the replacement or adjustment of the sharpener wheels in an extremely simple and expedient manner.

Other objects and attendant advantages of the present invention will readily be perceived hereafter.

The present invention relates to a guard construction for a rotary cutting machine having a base, a circular knife mounted on said base, motor means for driving said circular knife, and standard means for mounting said motor means above said base means comprising an elongated rod-like guard member, slot means in said rod-like guard member for receiving a segment on the periphery of said circular knife proximate said base, and mounting means for mounting said rod-like member on said base to permit movement of said guard member between a guarding position wherein said slot means receive said segment and an open position wherein said segment is exposed for cutting. In its more specific aspect, the guard construction includes, in combination with the rod-like member, a pair of sheet-like guard members and mounting means for mounting said sheet-like guard members on opposite sides of said circular knife above said segment portion of said knife to provide a guard for substantially the entire leading edge portion of the knife.

The present invention also relates to a knife sharpening construction for a circular knife of a cloth cutting machine comprising a sleeve, a sharpener shaft pivotally mounted in said sleeve, first and second arms on opposite sides of said sleeve, first and second ends on each of said first and second arms, first mounting means including indexing means for mounting said first ends of said first and second arms on and in a predetermined orientation relative to said sharpener shaft, first and second substantially coaxial bearing means, second mounting means mounting said first and second bearing means on said second ends of said first and second shafts, first and second sharpener wheel shafts mounted in said first and second bearing means, respectively, first and second sharpener wheels on said first and second sharpener wheel shafts, respectively, said first end of said first arm being free and unobstructed to permit removal of said first arm from said sharpener shaft without affecting said second arm, to thereby expose said first and second sharpener wheels and sharpener wheel shafts for replacement or repair.

The various aspects of the present invention will be more fully understood when the following portions of the specification are read in conjunction with the accompanying drawings:

FIG. 1 is a side elevational view of a mobile circular knife type of cloth cutting machine mounting the improved blade sharpening structure and the improved blade guard mechanism;

FIG. 2 is a fragmentary side elevational view taken on the opposite side of the machine from FIG. 1;

FIG. 3 is a fragmentary cross sectional view taken substantially along line 3—3 of FIG. 1 and showing the trigger mechanism for actuating the knife sharpening assembly;

FIG. 4 is a fragmentary cross sectional view taken substantially along line 4—4 of FIG. 3;

FIG. 5 is a fragmentary cross sectional view taken substantially along line 5—5 of FIG. 1 and showing the relationship between the sharpener shaft and the various arms mounted thereon;

FIG. 6 is a fragmentary cross sectional view taken substantially along line 6—6 of FIG. 1 and showing the structure for mounting the knife sharpener mechanism on the frame of the machine and also showing the base of the machine;

FIG. 7 is a cross sectional view taken substantially along line 7—7 of FIG. 1 and showing the structure for mounting the sharpener wheels on the arms and also showing the structure for mounting the sheet-like blade guards on the sharpener arms;

FIG. 8 is a fragmentary enlarged side elevational view of a portion of FIG. 1 and showing the sheet-like guards in the positions which they occupy both when the sharpener wheels are dormant and being used;

FIG. 9 is a fragmentary cross sectional view taken substantially along line 9—9 of FIG. 1 and showing the structure for holding the rod-like blade guard in an adjusted position;

FIG. 10 is a fragmentary cross sectional view taken substantially along line 10—10 of FIG. 1 and showing the structure of a portion of the blade guard with the blade positioned therein;

FIG. 11 is a fragmentary side elevational view of a portion of FIG. 1 but showing a different mounting structure for a portion of the blade guard; and FIG. 12 is a fragmentary cross sectional view taken substantially along line 12—12 of FIG. 11 and showing a modified form of rod-type blade guard structure.

Broadly, and by way of preview, the mobile cloth cutting machine 10 includes an improved sharpening mechanism 11 and an improved blade guard mechanism 12 which are mounted on the machine.

The improved cutting machine 10 includes a generally planar base 13 which is adapted to rest on a surface 23 and to be moved about underneath the material which is to be cut. Rigidly affixed to and extending upwardly from base 13 is a standard 14 which is only slightly wider than circular blade or knife 15. A frame 16 is attached to standard 14 by a series of screws 17 and in turn supports a housing 19 in which an electric motor is mounted which receives electric current through a plug 20. A suitable bevel gear drive extends from the motor through housing portion 21' for driving blade 15. A first main handle 21 is attached to frame 16 and a second T-shaped handle 22 is attached to motor housing 19. In operation, an operator grasps handle 21 with one hand and handle 22 with the other hand to guide machine 10 in its desired path with base 13 rolling on surface 23 by means of four rollers 24.

Periodically blade 15 must be sharpened. To this end, sharpening mechanism 11 is used. More specifically, plate 25 of sharpener 11 is attached to frame portion 26 of frame 16 by means of screws 27 (FIG. 6). A flange 29, formed integrally with sleeve 30, is attached to plate 25 by means of screws 31. A sharpener shaft 32 is mounted for pivotal movement in sleeve 30. Shaft 32 includes a V-shaped keyway or groove 33 which receives the ends of set screws 34, 35 and 36. Set screw 34 extends through rocker arm 37. Set screw 35 extends through sharpener arm 38 and set screw 36 extends through sharpener arm 39. Because of the fact that the set screws are received in V-groove or keyway 33, arms 37, 38 and 39 will all automatically assume their proper orientation relative to sharpener shaft 32 and relative to each other. Thus, keyway 33 and the set screws 34, 35 and 36 constitute an indexing arrangement. A spiral spring 40 has end 41 bearing on the undersurface 42 of frame portion 26 (FIG. 8) and the opposite end located within slot 43 of shaft 32 so that this spring will bias shaft 32 in a counterclockwise direction.

Normally sharpener wheels 44, which are mirror images of each other, occupy the solid line position shown in FIG. 8. However, when it is desired to bring them into engagement with the edge 45 of circular knife 15, it is merely necessary to pull trigger 46 so that it will pivot in a clockwise direction (FIG. 4) about pin 47 mounted on frame portion 49. This will cause rod 50 to move in the direction of arrow 51 (FIG. 8) to thereby move sharpener wheels 44 from the solid line to the dotted line position in FIG. 8 because the end of rod 50 remote from trigger 46 is received in rocker arm 37 while the end of rod 50 adjacent trigger 46 is received in portion 52 of trigger 46. The sharpener wheels 44, which may be fabricated from any suitable abrasive materials, will engage the knife 15 at the proper angle to effect the necessary sharpening action. After sharpening is completed, trigger 46 is released and spring 40 will return the sharpener mechanism to the solid line position shown in FIG. 8.

In accordance with one aspect of the present invention, the sharpener mechanism 11 is fabricated in a manner which is not only extremely economical but also lends itself to rapid and efficient disassembly for the purpose of replacing wheels 44 while also permitting the parts to be assembled easily and simply without the use of gauges. In this respect, in order to replace wheels 44, all that need be done is to loosen set screw 36 (FIG. 5) which in turn permits arm 39 to be removed from shaft 32 by pulling it to the right in FIG. 7. Thereafter all that need be done to replace the wheel 44 on arm 39 is to remove screw 53 from shaft 54 on which it is mounted. As can be seen, shaft 54 includes an enlarged annular end 55 which prevents it from moving to the right in bearing 56 which is mounted within split ring portion 63 of arm 39. The shank of screw 60 is received in shaft 54 and the head 59 of the screw bears against bearing 56 to prevent shaft 54 from moving to the left. The mounting structure for the left wheel 44 in FIG. 7 constitute mirror image counterparts of the structure for the right wheel and such parts are designated by the same numerals having primes associated therewith to obviate the necessity for additional description. Arms 39 and 38 are spaced from sleeve 30 by means of washers 61. As noted above, once arm 39 has been removed, complete access is had to all of the mounting parts for wheels 44 to permit removal or replacement thereof as may be required. After a new right wheel 44 has been installed, arm 39 may be reinstalled very easily by merely slipping it onto the end of shaft 32 and thereafter tightening set screw 36 so that its lower end is received in keyway or groove 33.

While wheels 44 are installed, as shown in FIG. 7, it is necessary to adjust them axially relative to each other as they become worn. To this end, bearings 56–56' are mounted in split rings 62 and 63 at the outer ends of arms 38 and 39, respectively. To adjust left wheel 44 (FIGS. 7 and 8), it is merely necessary to loosen screw 64 (FIG. 8) so as to permit the opposite sides of split ring 62 to spread slightly apart to thereby loosen their grip on sleeve 56'. Thereafter, it is merely necessary to digitally grasp the knurled circular surface 65 and rotate it so that the threaded outer surface 66 of sleeve 56' will thread through the tapped portion 67 of split ring 62. After bearing 56' has reached its desired axial position, screw 64 is retightened to clamp it firmly in position. An analogous adjustment of bearing 56 in arm 39 may be made by loosening screw 64' associated with split ring 63 at the end of arm 39. Thereafter, bearing 56 is threaded through arm 39 to the desired axial position and thereafter screw 64' is retightened to hold bearing 56 in its desired axial position.

It can thus be seen that wheels 44 may be removed and adjusted in an extremely simple manner, and after the sharpener arm 39 is reassembled after replacement of wheels 44, the assembly will be in perfect alignment provided that set screw 36 is received in the groove 33. No other adjustments are required. If it is desired to completely disassemble the sharpener mechanism 11 for any reason whatsoever, after the right end of rod 50 (FIG. 8) is removed from arm 37, and after arm 39 has been removed after loosening set screw 36, it is merely required that shaft 32 be moved to the left in FIG. 5 to completely remove both arms and the associated mechanism from sleeve 30.

In addition to functioning in the above described manner, arms 38 and 39 serve as supports for sheet-like knife guards 69 and 70. In this respect, guard 69 is attached to the inside of arm 38 by mens of screws 71 and 72. Guard 70 is attached to arm 39 by means of screws 73 and 74. Guards 69 and 70 are preferably made of transparent plastic material to permit viewing of the knife 15 therethrough. However, they need not be so constructed as they can be made out of metal or opaque plastic, or if desired, can be made of a screen which will permit viewing therethrough. Preferably the guards are slightly dished or concave toward knife 15.

When wheels 44 are in the solid line position of FIG. 8, it can be seen how guards 69 and 70, which are mirror images of each other, will obstruct the upper peripheral portion of the knife 15. The edges 75 and 76 of guards 69 and 70, respectively, are curved so as not to engage any part of the machine when arms 38 and 39 are pivoted to the dotted line position shown in FIG. 8. It can readily be seen that guards 69 and 70 can be removed from arms 38 and 39, respectively, without requiring disassembly of the arms from the remainder of the sharpener structure and without in any way requiring adjustment or repositioning of wheels 44 and without requiring the loosening of any of the mounting members for wheels 44. Therefore, even though the guards 69 and 70 are mounted on the sharpener arms 38 and 39, they do not interfere with proper operation or mounting of the sharpener mechanism 11 nor does the sharpener mechanism 11 interfere with proper operation or mounting of guards 69 and 70. In other words, they are compatible with each other and will not interfere with each other.

Guard members 69 and 70 actually cooperate with guard rod 77 which is mounted in channel-shaped holder 79 (FIG. 9) secured to motor housing 19 by means of bracket portion 80 formed with channel member 79. Rod-like guard 77 may move between a solid-line position and the dotted-line position shown in FIG. 1 and may be retained in any intermediate position by tightening thumb screw 81 which rides in elongated slot 82 in holder 79. The lower end of rod 77 is slotted at 83 for a sufficient portion of its length so as to receive a segment on the periphery of blade 15. As can be seen from FIGS. 1 and 2, practically the entire leading portion of blade 15 is guarded by rod 77 in combination with guards 69 and 70. It is to be especially noted that the horizontal space between guards 69 and 70 (FIG. 7) is open and unobstructed so that the sparks which are generated during sharpening are free to leave the machine. Also, because slots 83 in rod 77 is relatively small and because it is continually cleaned by knife 15 therein, there can be no appreciable accumulation of lint, which in combination with the sparks, could constitute a fire hazard. In this respect, in other types of devices which utilize a relatively large encompassing guard, the accumulaton of lint in the guard, in combination with the sparks generated during knife sharpening, could constitute a fire hazard. This is obviated because of the open knife guard structure of the present construction which permits the sparks to be dissipated to the surroundings rather than acting as a catch-all for lint to which the sparks may be applied.

A modified form of the rod structure is shown at 77' in FIGS. 11 and 12. In this respect, the slot 83' extends throughout rod 77' rather than merely constituting a channel therein. This can be understood by comparing FIGS. 10, 11 and 12. In addition, bracket 80' of FIG. 11 is made adjustable by means of a locking screw 85 so as to permit the adjustment of the tilt of holder 79' which corresponds to holder 79 of FIG. 9. With the embodiment of FIGS. 11 and 12, a greater degree of adjustment may be obtained so that the segment which is covered by the lower portion of the rod may be adjusted, as required. If desired, a suitable stop mechanism, not shown, may be provided to limit the counterclockwise rotation of rod 77' in FIG. 11.

It can thus be seen that the present invention possesses the above discussed advantages and while preferred embodiments have been disclosed, it will readily be appreciated that the present invention is not limited thereto but may be otherwise embodied within the scope of the following claims.

What is claimed is:

1. A guard construction for a rotary cutting machine having a base, a circular knife mounted on said base, motor means for driving said circular knife, and standard means for mounting said motor means above said base, comprising an elongated rod-like guard member, slot means in said rod-like guard member for receiving a segment on the periphery of said circular knife approximate said base, and mounting means for mounting said rod-like member on said base to permit movement of said guard member between a guarding position wherein said slot means receive said segment and an open position wherein said segment is exposed for cutting.

2. A guard construction as set forth in claim 1 wherein said mounting means comprise holder means for receiving said guard with a sliding fit.

3. A guard construction as set forth in claim 1 including first and second sheet-like guard members, and guard mounting means for mounting said first and second guard members on opposite sides of said circular knife above said segment portion of said knife.

4. A guard construction as set forth in claim 3 wherein said sheet-like guard members are transparent.

5. A guard construction as set forth in claim 3 including a pair of spaced knife sharpener wheel means, first and second arm means mounting said sharpener wheel means on opposite sides of the upper portion of said circular knife above said segment, arm mounting means for mounting said first and second arm means for pivotal movement in unison about a substantially horizontal axis to cause said wheel means to move between a first position wherein they are spaced from said circular knife and a second position wherein they engage said knife in knife-sharpening relationship above said segment, said guard mounting means mounting said first and second sheet-like guard members on said first and second arm means, respectively, said rod-like member and said arm mounting and said wheel means and said guard members being so oriented relative to each other to permit said wheel means to be moved to said second position in both said guarding position and said open position of said rod-like member.

6. A guard construction as set forth in claim 5 wherein said arm mounting means comprise sleeve means mounted on said standard means, a sharpener shaft pivotally mounted on said sleeve means, a keyway in said sharpener shaft, said first and second arms having first and second ends, and key means mounting said first ends of said first and second arms on said sharpener shaft to thereby positively position said first and second arms relative to said sharpener shaft.

7. A guard construction as set forth in claim 6 wherein said key means comprise set screws.

8. A guard construction as set forth in claim 6 wherein said second ends of said first and second arm means are formed into first and second split rings, respectively, first and second substantialy coaxial bearing means mounted in said first and second split rings, respectively, for adjusting movement in a substantially horizontal direction toward and away from each other, and screw means for tightening said first and second split rings to clamp said first and second bearing means, respectively, in adjusted positions, and said guard mounting means mounting said first and second sheet-like guard means intermediate said first and second ends of said first and second arms, respectively, whereby said first and second arms may be demounted from said sharpener shaft without interference from said first and second sheet-like guard means, and whereby said first and second bearing means may be adjusted without interference from and without affecting the position of said first and second sheet-like guard means.

9. A guard construction as set forth in claim 8 wherein said guard mounting means comprise screws.

10. A knife sharpening construction for a circular knife of a cloth cutting machine comprising a sleeve, a sharpener shaft pivotally mounted in said sleeve, first and second arms on opposite sides of said sleeve, first and second ends on each of said first and second arms, first separate mounting means including indexing means fixedly mounting said first ends of said first and second arms on and in a predetermined orientation relative to said sharpener shaft, first and second substantially coaxial bearing means, second mounting means mounting said first and second bearing means on said second ends of said first and second arms, respectively, first and second sharpening wheel shafts mounted in said first and second bearing means, respectively, and first and second sharpening wheels on said first and second sharpening wheel shafts, respectively, said first end of said first arm being free and unobstructed to permit removal of said first arm from said sharpener shaft without affecting said fixed mounting of said second arm on said sharpener shaft, to thereby expose said first and second sharpener wheels, and sharpener wheel shafts for replacement or repair.

11. A knife sharpening construction as set forth in claim 10 wherein said first mounting means for said first arm comprises a set screw on said first arm and a keyway in said sharpener shaft for receiving said set screw.

12. A knife sharpening construction as set forth in claim 11 wherein said first mounting means for said second arm comprises a second set screw and a keyway in said sharpener shaft for receiving said set screw.

13. A knife sharpening construction as set forth in claim 11 wherein said second ends of said first and second arms are formed into split rings for receiving said first and second bearing means, respectively, and first and second screws for tightening said first and second split rings, respectively, to hold said first and second bearing means, respectively, in adjusted positions.

* * * * *

UNITED STATES PATENT OFFICE

CERTIFICATE OF CORRECTION

PATENT NO. : 4,062,111

DATED : December 13, 1977

INVENTOR(S) : Frederick G. Clark

It is certified that error appears in the above-identified patent and that said Letters Patent are hereby corrected as shown below:

Column 1, line 7, after "knife" insert --type--.
Column 5, line 17, change "mens" to --means--.
Column 6, line 66, (claim 5) after "mounting" insert --means--.

Signed and Sealed this

*Seventh* Day of *March 1978*

[SEAL]

*Attest:*

RUTH C. MASON
*Attesting Officer*

LUTRELLE F. PARKER
*Acting Commissioner of Patents and Trademarks*